US008684495B2

(12) United States Patent
Nakamoto

(10) Patent No.: US 8,684,495 B2
(45) Date of Patent: Apr. 1, 2014

(54) LIQUID EJECTION HEAD AND METHOD OF MANUFACTURING THE SAME

(75) Inventor: Hikaru Nakamoto, Inuyama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 59 days.

(21) Appl. No.: 13/071,470

(22) Filed: Mar. 24, 2011

(65) Prior Publication Data

US 2011/0242216 A1 Oct. 6, 2011

(30) Foreign Application Priority Data

Mar. 30, 2010 (JP) ..... 2010-077381

(51) Int. Cl.
*B41J 2/14* (2006.01)

(52) U.S. Cl.
USPC ..... 347/47; 347/40; 347/43

(58) Field of Classification Search
USPC ..... 347/47, 40, 43, 12
See application file for complete search history.

(56) References Cited

U.S. PATENT DOCUMENTS

| | | | | |
|---|---|---|---|---|
| 2006/0152549 | A1* | 7/2006 | Asuke | 347/45 |
| 2009/0128600 | A1* | 5/2009 | Nagata et al. | 347/40 |

FOREIGN PATENT DOCUMENTS

| | | | |
|---|---|---|---|
| CN | 1803455 | A | 7/2006 |
| CN | 101291812 | A | 10/2008 |
| EP | 0943411 | A1 | 9/1999 |
| JP | H05-193140 | A | 8/1993 |
| JP | 2003-276204 | A | 9/2003 |
| JP | 2005-212286 | A | 8/2005 |
| JP | 2006-192669 | A | 7/2006 |
| JP | 2006-264147 | A | 10/2006 |
| JP | 2006-334910 | A | 12/2006 |
| JP | 2007-144711 | A | 6/2007 |

OTHER PUBLICATIONS

Japan Patent Office, Notification of Reason for Refusal for Japanese Patent Application No. 2010-077381, dispatched Feb. 21, 2012.
European Patent Office, extended European Search Report for European Patent Application No. 11002315.7, dated Jun. 7, 2011.
State Intellectual Property Office of the People'S Republic of China, Notification of the Second Office Action for Chinese Patent Application No. 201110070635.5 (counterpart to above-captioned patent application), mailed Nov. 25, 2013.

* cited by examiner

*Primary Examiner* — Henok Legesse
(74) *Attorney, Agent, or Firm* — Baker Botts L.L.P.

(57) ABSTRACT

A liquid ejection head includes: a plate base material; and an actuator; wherein the plate base material has: ejection holes having recessed portions; and an ejection face having ejection openings. The recessed portions include pairs each constituted by two recessed portions located side by side and at least one of which has the ejection openings. A shortest line segment of a certain pair is equal to or shorter than that of another pair, an average value of lengths of the respective recessed portions constituting the certain pair is not larger than that of lengths of the respective recessed portions constituting another pair.

18 Claims, 11 Drawing Sheets

LIQUID EJECTION HEAD AND METHOD OF MANUFACTURING THE SAME

CROSS REFERENCE TO RELATED APPLICATION

The present application claims priority from Japanese Patent Application No. 2010-077381, which was filed on Mar. 30, 2010, the disclosure of which is herein incorporated by reference in its entirety.

BACKGROUND OF THE INVENTION

1. Field of the Invention

The present invention relates to a liquid ejection head having an ejection face in which are formed ejection openings for ejecting liquid droplets and to a method of manufacturing the liquid ejection head.

2. Description of the Related Art

There is an ink jet head having an ejection face in which a water repellent layer is formed on peripheries of nozzle openings in order to enhance ink ejection properties. In such an ink jet head, there is known a technique that the nozzle openings are formed in a bottom portion of each of elongated holes formed in the ejection face in order to protect the water repellent layer from a wiper for wiping the ink-ejection face.

SUMMARY OF THE INVENTION

In a process of manufacturing such an ink-jet head, when the water repellent layer is formed on the ink-ejection face, an unnecessary water repellent layer may be formed in each nozzle. Thus, only the ink-ejection face is masked by covering the ink-ejection face with a masking material, and then the unnecessary water repellent layer in each nozzle is removed. In the above-described technique, shapes and positional relationships of the elongated holes formed in the ejection face may cause unequal or different amounts of the masking material entering into the respective elongated holes when the ejection face is covered with the masking material. In the case where the amounts of the masking material entering into the respective elongated holes are unequal, it is difficult to accurately adjust a pressure at which the masking material is bonded to the ejection face, such that the masking material does not enter into each nozzle. This makes it difficult to accurately remove only the water repellent layer formed in each nozzle. Where the water repellent layer unequally remains in the nozzle, variations in ejection properties are caused among the nozzles, leading to a deterioration of a recording property.

This invention has been developed in view of the above-described situations, and it is an object of the present invention to provide a liquid ejection head which can reduce variations in liquid ejection properties among ejection openings and a method of manufacturing the liquid ejection head.

The object indicated above may be achieved according to the present invention which provides a liquid ejection head comprising: a plate base material; and an actuator configured to apply a liquid-droplet ejection energy to liquid in the plate base material; wherein the plate base material has: a plurality of ejection holes formed therein in a thickness direction thereof for ejecting liquid droplets; and an ejection face having a plurality of ejection openings opened therein, wherein the liquid droplets are ejected through the plurality of ejection holes and the plurality of ejection openings; wherein the ejection face has a plurality of recessed portions formed therein, and each of at least one of the plurality of recessed portions has a bottom portion in which the plurality of ejection openings are opened; wherein the plurality of recessed portions include a plurality of pairs thereof, each pair being constituted by two recessed portions located side by side and respectively having bottom portions in at least one of which the ejection openings are formed; wherein, where a shortest line segment of a certain pair of the recessed portions as a shortest one of line segments connecting outlines of the respective two recessed portions constituting the certain pair is equal to or shorter than that of another pair of the recessed portions, an average value of lengths of the respective two recessed portions constituting the certain pair is equal to or smaller than that of lengths of the respective two recessed portions constituting said another pair; wherein a liquid repellent layer is formed on the bottom portion of the recessed portion in which the ejection openings are formed, wherein the liquid repellent layer formed on the bottom portion is a layer having not been removed due to a masking material having entered into the recessed portion and covered the liquid repellent layer.

It is noted that, in the above-described liquid ejection head, the plurality of recessed portions may be constituted only by the plurality of pairs of the recessed portions, each pair being constituted by two recessed portions located side by side and respectively having the bottom portions.

The object indicated above may be achieved according to the present invention which provides a method of manufacturing a liquid ejection head, the liquid ejection head including: a plate base material having: a plurality of ejection holes formed therein in a thickness direction thereof for ejecting liquid droplets; and an ejection face having a plurality of ejection openings opened therein, wherein the liquid droplets are ejected through the plurality of ejection holes and the plurality of ejection openings; and an actuator configured to apply a liquid-droplet ejection energy to liquid in the plate base material, the method comprising: a base-material forming step of forming, in the plate base material, (a) a plurality of recessed portions formed in the ejection face and (b) the plurality of ejection holes respectively having the plurality of ejection openings opened in a bottom portion of each of at least one of the plurality of recessed portions; a liquid-repellent-layer forming step of forming a liquid repellent layer on the ejection face in which the plurality of recessed portions are formed; a compression-bonding step of compressing and bonding a masking material onto the ejection face such that the masking material enters into the plurality of recessed portions; a liquid-repellent-layer removing step of removing a liquid repellent layer not covered by the masking material; a masking-material removing step of removing the masking material from the plate base material after the liquid-repellent-layer removing step; wherein the base-material forming step is a step of forming the plurality of recessed portions such that the plurality of recessed portions include a plurality of pairs thereof, each pair being constituted by two recessed portions located side by side and respectively having bottom portions in at least one of which the ejection openings are formed and such that, where a shortest line segment of a certain pair of the recessed portions as a shortest one of line segments connecting outlines of the respective two recessed portions constituting the certain pair is equal to or shorter than that of another pair of the recessed portions, an average value of lengths of the respective two recessed portions constituting the certain pair is equal to or smaller than that of lengths of the respective two recessed portions constituting said another pair.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DESCRIPTION OF THE EMBODIMENT

Hereinafter, there will be described an embodiment of the present invention by reference to the drawings.

Figure 1:
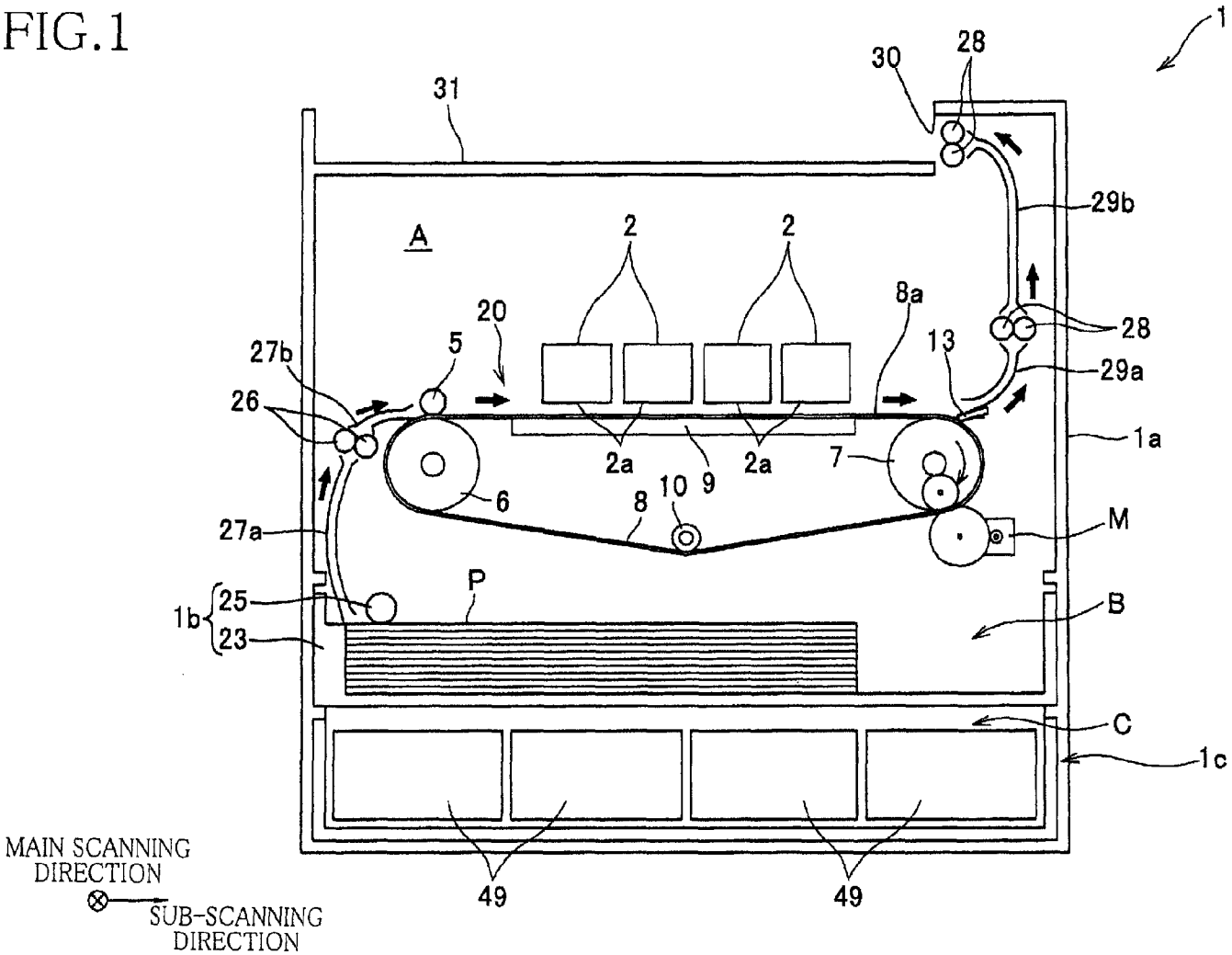
FIG. 1 is a schematic view showing an internal structure of an ink-jet printer as an embodiment of the present invention.

An ink-jet printer 1 is a color ink-jet printer of a line type. As shown in FIG. 1, the printer 1 includes a casing 1*a* having a rectangular parallelepiped shape. A sheet-discharge portion 31 is provided at an upper portion of the casing 1*a*. An inside of the casing 1*a* is divided into three spaces A, B, and C in order from an upper side thereof. Each of the spaces A and B is a space in which a sheet feeding path continued to the sheet-discharge portion 31 is defined. In the space A, a sheet is fed and an image is recorded on the sheet. In the space B, the sheet or sheets are accommodated and each sheet is supplied to the space A. In the space C, an ink supply source is accommodated, allowing inks to be supplied.

In the space A, there are disposed (a) four ink jet heads 2, (b) a sheet-feed unit 20 configured to feed the sheet, (c) guide portions for guiding the sheet, and so on. Each of the four heads 2 is a line-type head elongated in a main scanning direction and having a generally rectangular parallelepiped shape as an external shape. The heads 2 respectively have lower faces as ink-ejection faces 2*a* from which inks of four colors, namely, magenta, cyan, yellow, and black are respectively ejected as ink droplets. The heads 2 are arranged so as to be spaced at predetermined pitches in a sub-scanning direction which is perpendicular to the main scanning direction.

As shown in FIG. 1, the sheet-feed unit 20 includes (a) belt rollers 6, 7, (b) an endless sheet-feed belt 8 wound around the rollers 6, 7, (c) a nip roller 5 and a peeling plate 13 disposed on an outside of the sheet-feed belt 8 in the sub-scanning direction, (d) a platen 9 and a tension roller 10 disposed on an inside of the sheet-feed belt 8 in the sub-scanning direction, and so on. The belt roller 7 is a drive roller which is rotated by a feeding motor M in a clockwise direction in FIG. 1. During the rotation of the belt roller 7, the sheet-feed belt 8 is rotated or circulated along bold arrow shown in FIG. 1. The belt roller 6 is a driven roller which is rotated in the clockwise direction in FIG. 1 with the rotation of the sheet-feed belt 8. The nip roller 5 is disposed so as to face the belt roller 6 and configured to press each sheet P supplied from a sheet-supply unit 1*b* along an upstream guide portion, onto an outer circumferential face 8*a* of the sheet-feed belt 8. The peeling plate 13 is disposed so as to face the belt roller 7 and configured to peel each sheet P from the outer circumferential face 8*a* to feed or convey each sheet P to a downstream guide portion. The platen 9 is disposed so as to face the four heads 2 and supports an upper portion of the sheet-feed belt 8 from an inside thereof. As a result, a space suitable for an image recording is formed between the outer circumferential face 8*a* and the ink-ejection faces 2*a* of the respective heads 2. The tension roller 10 presses or urges a lower portion of the belt roller 7 downward, which removes slack of the sheet-feed belt 8.

The guide portions are arranged on opposite sides of the sheet-feed unit 20 in the sub-scanning direction. The upstream guide portion includes guides 27*a*, 27*b* and a pair of sheet-feed rollers 26. This upstream guide portion connects the sheet-supply unit 1*b* and the sheet-feed unit 20 to each other. The downstream guide portion includes guides 29*a*, 29*b* and two pairs of sheet-feed rollers 28. This downstream guide portion connects the sheet-feed unit 20 and the sheet-discharge portion 31 to each other.

The sheet-supply unit 1*b* is disposed in the space B. The sheet-supply unit 1*b* includes a sheet-supply tray 23 and a sheet-supply roller 25. The sheet-supply tray 23 can be mounted on and removed from the casing 1*a*. The sheet-supply tray 23 has a box-like shape opening upward so as to accommodate a plurality of sheets P. The sheet-supply roller 25 supplies, to the upstream guide portion, an uppermost one of the sheets P accommodated in the sheet-supply tray 23.

As described above, in the space A and the space B is formed the sheet feeding path extending from the sheet-supply unit 1*b* to the sheet-discharge portion 31 via the sheet-feed unit 20. The sheet P supplied from the sheet-supply tray 23 is fed along the guides 27*a*, 27*b* to the sheet-feed unit 20 by the sheet-feed rollers 26. When the sheet P is fed in the sub-scanning direction through a position just below the heads 2, the ink droplets are ejected in order from the heads 2 to record or form a color image on the sheet P. The sheet P is peeled at a right end of the sheet-feed belt 8 and fed upward along the guides 29*a*, 29*b* by the two sheet-feed rollers 28. The sheet P is then discharged onto the sheet-discharge portion 31 through an opening 30.

Here, the sub-scanning direction is parallel to a sheet feeding direction in which the sheet P is fed by the sheet-feed unit 20, and the main scanning direction is parallel to a horizontal plane and perpendicular to the sub-scanning direction.

In the space C, there is disposed an ink tank unit 1*c* which can be mounted on and removed from the casing 1*a*. The ink tank unit 1*c* accommodates therein four ink tanks 49 arranged in a row. The respective inks in the ink tanks 49 are supplied to the heads 2 through tubes, not shown.

There will be next explained the heads 2 with reference to FIGS. 2-6. It is noted that, in FIG. 3, pressure chambers 110, apertures 112, and nozzle holes 108 illustrated by solid lines for easier understanding purposes although these elements are located under actuator units 21 and accordingly should be illustrated by broken lines. Further, since the four heads 2 have the same configuration, an explanation is given for one of the heads 2 for the sake of simplicity.

Figure 2:
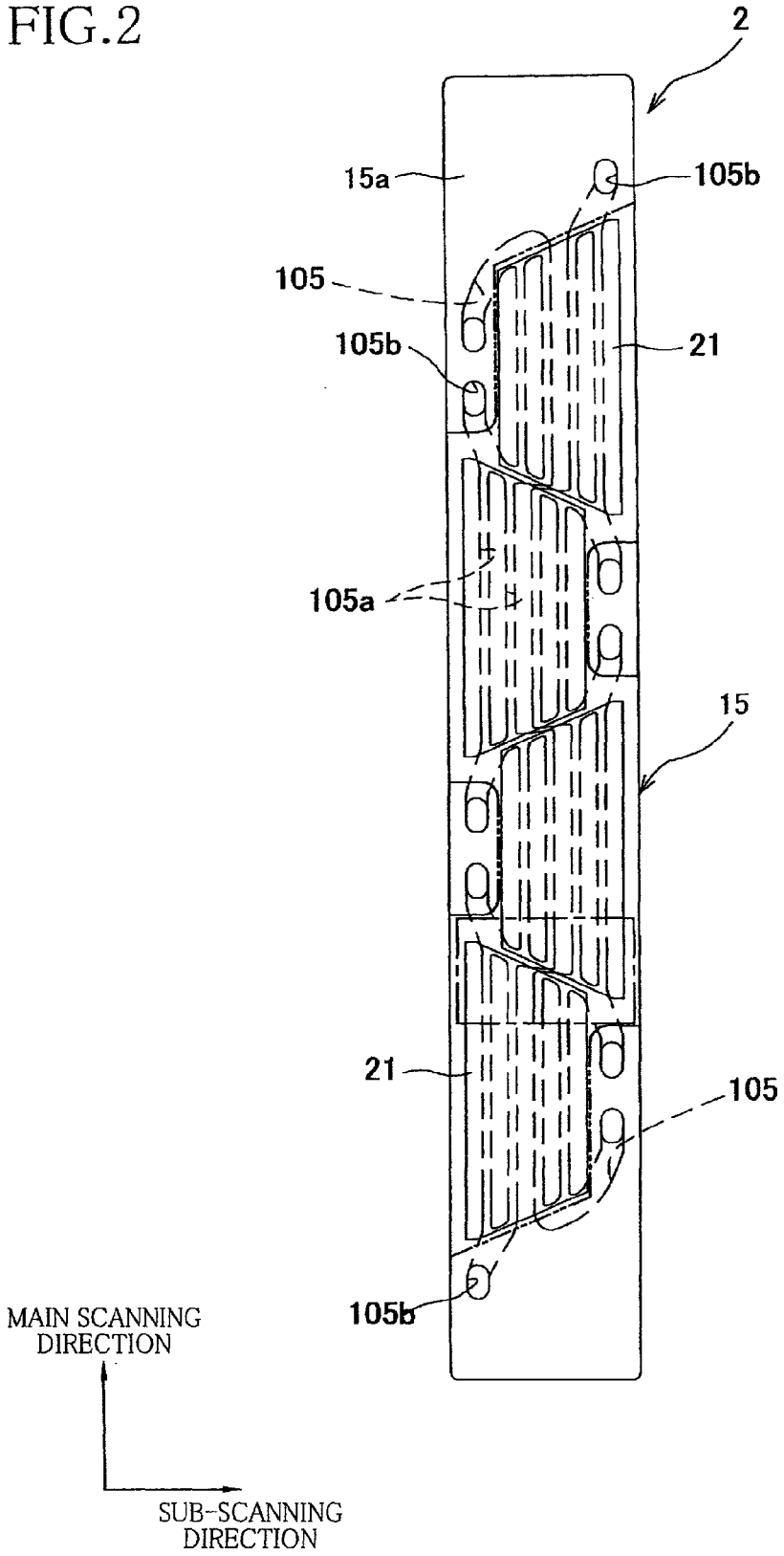
FIG. 2 is a view showing an upper face of an ink-jet head shown in FIG. 1.
Figure 3:
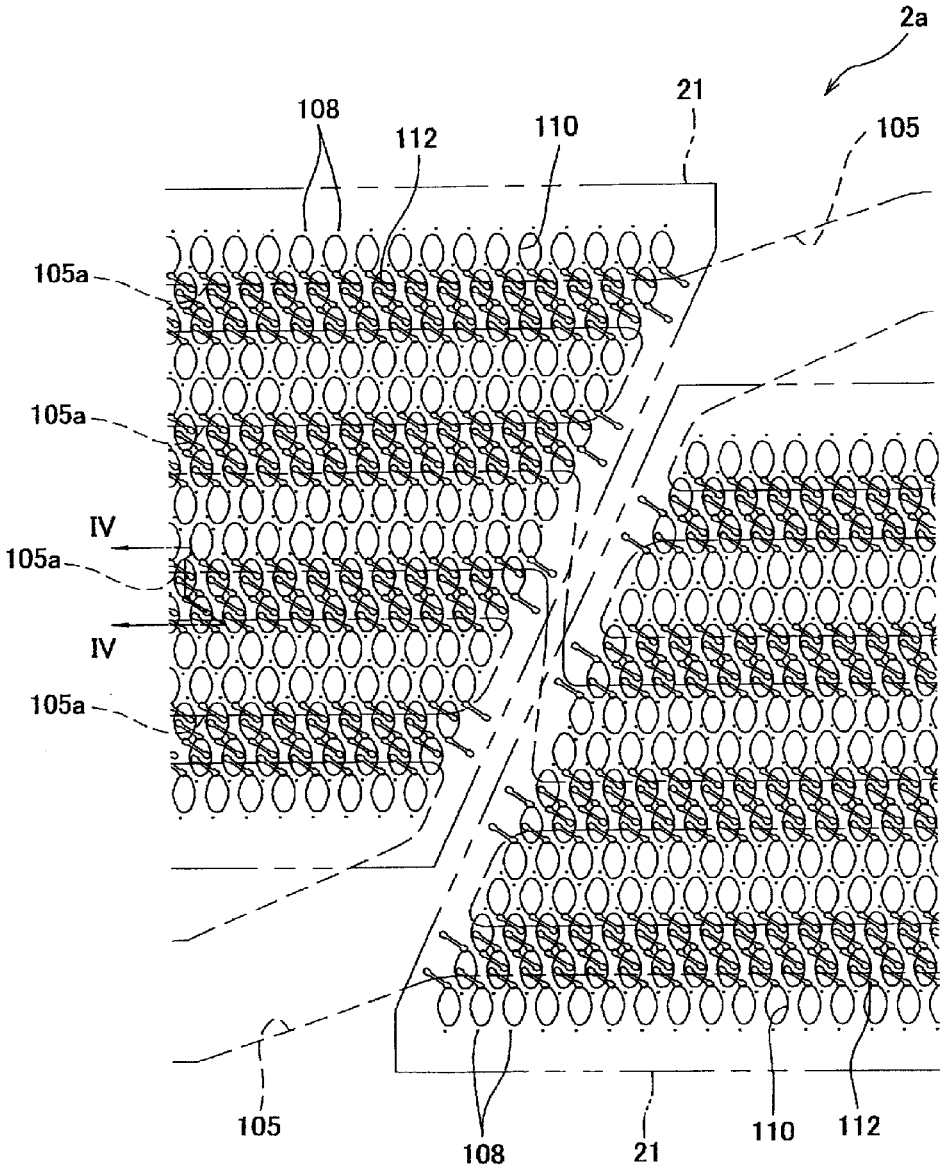
FIG. 3 is an enlarged view of an area enclosed by a one-dot chain line shown in FIG. 2.
Figure 4:
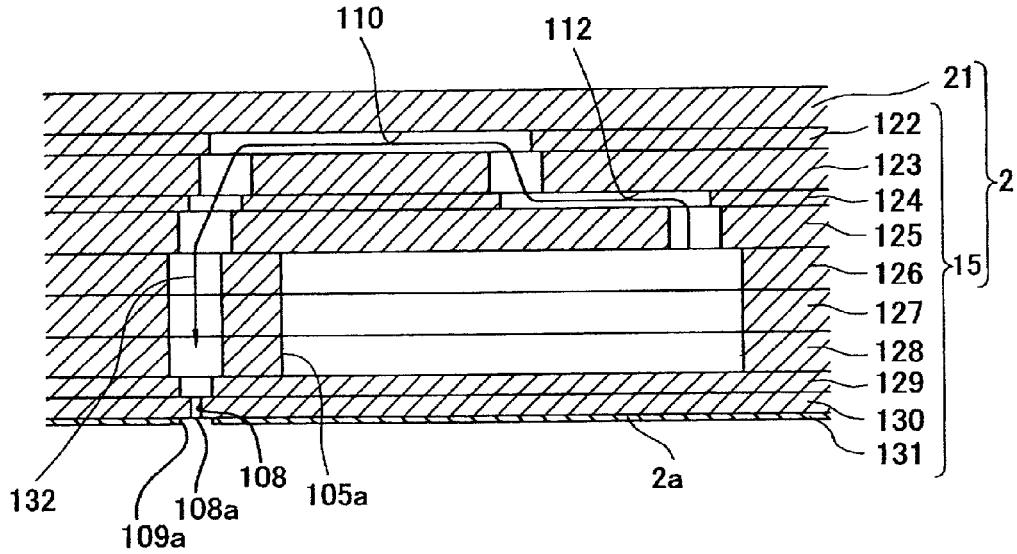
FIG. 4 is a cross-sectional view taken along a line IV-IV in FIG. 3.

As shown in FIG. 2, the four actuator units 21 are fixed to an upper face 15*a* of a channel unit 15. As shown in FIGS. 3 and 4, in the channel unit 15, there are formed ink channels having a plurality of the pressure chambers 110 and so on. Each of the actuator units 21 includes a plurality of actuators respectively corresponding to the pressure chambers 110 and has a function for selectively applying ejection energy to the ink in the pressure chambers 110 by being driven by a driver IC, not shown.

The channel unit 15 has a rectangular parallelepiped shape. The upper face 15*a* of the channel unit 15 has ten ink-supply openings 105*b* opened therein to which the ink is supplied from an ink reservoir, not shown. As shown in FIGS. 2 and 3, in the channel unit 15, there are formed (a) manifold channels 105 each of which communicates with corresponding two of ink-supply openings 105*b* and (b) sub-manifold channels 105*a* branched from each manifold channel 105. A lower face of the channel unit 15 functions as the ink-ejection face 2*a* in which a multiplicity of ink-ejection openings 108*a* (openings of the respective nozzle holes 108) are formed so as to be arranged in matrix. Likewise, a multiplicity of the pressure chambers 110 are formed in the upper face 15*a* of the channel unit 15 so as to be arranged in matrix.

Figure 6:
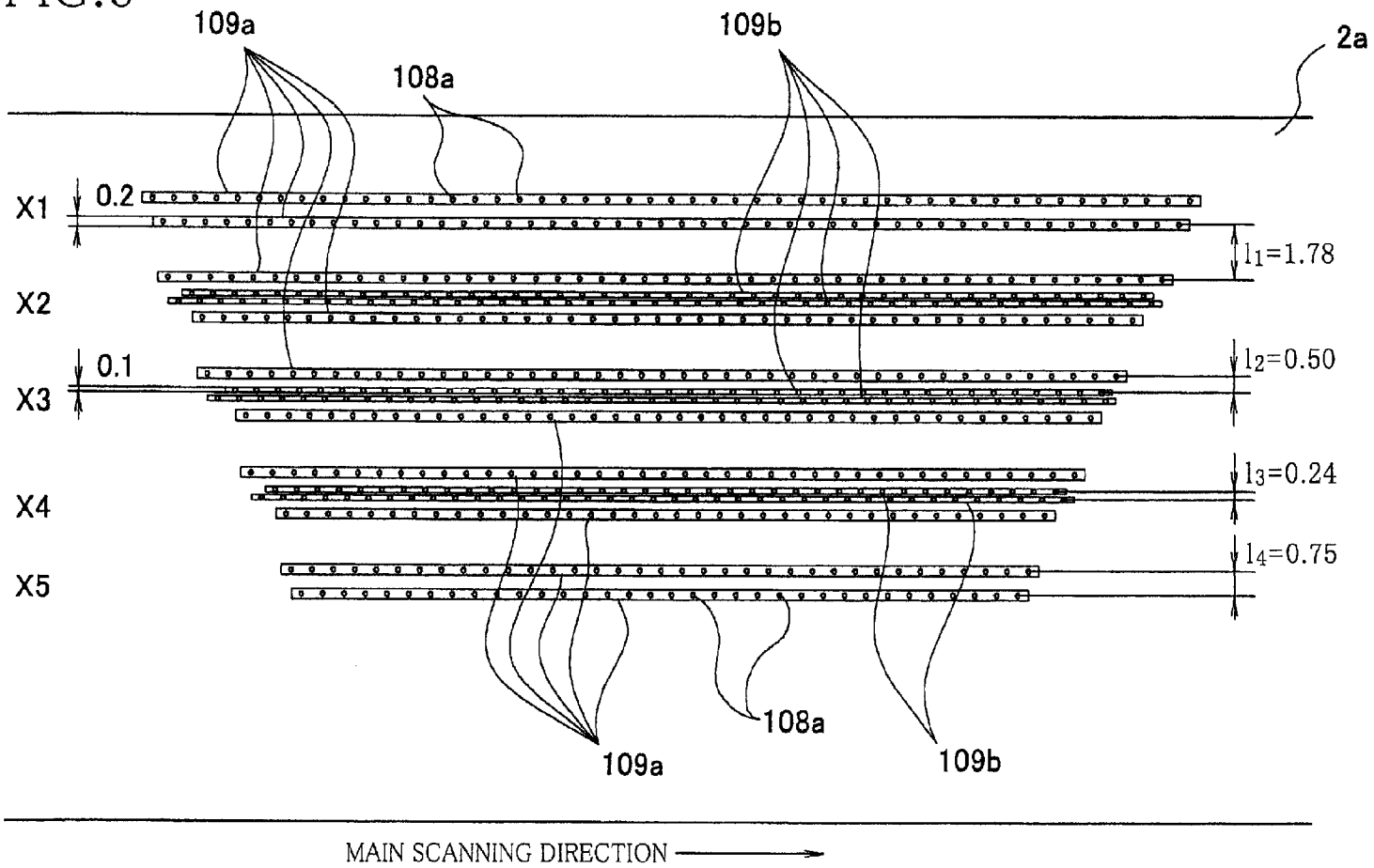
FIG. 6 is a partly enlarged view of an ink-ejection face shown in FIG. 4.

In the present embodiment, the pressure chambers 110 formed in an area opposed to each of the actuator units 21 constitute sixteen pressure-chamber rows in each of which the pressure chambers 110 are arranged in the main scanning direction so as to be equally spaced from one another. These pressure-chamber rows are arranged in parallel in the sub-scanning direction. In correspondence with an outer shape (a trapezoid shape) of each of the actuator units 21, the number of the pressure chambers 110 included in each of the pressure-chamber rows gradually decreases from a longer side toward a shorter side of the trapezoid shape of each actuator unit 21. The ink-ejection opening 108*a* are also arranged in a manner similar to the manner of the arrangement of the pressure chambers 110. Thus, as shown in FIG. 6, in correspondence with the pressure chamber rows, the ink-ejection openings 108*a* formed in the ink-ejection face 2*a* constitute sixteen ink-ejection-opening rows in which the ink-ejection openings 108*a* are arranged in the main scanning direction. The ink-ejection-opening rows are arranged in parallel in the sub-scanning direction.

As shown in FIG. 4, the channel unit 15 is constituted by nine plates 122-130 and a plated layer 131. Each of the nine plates 122-130 is formed of a metal material such as stainless steel, and the plated layer 131 formed of nickel is formed on a surface of the plate 130. Each of the plates 122-130 and the plated layer 131 has a rectangular flat face elongated in the main scanning direction.

Through holes formed through the respective plates 122-130 are communicated with one another by stacking the plates 122-130 on one another while positioning. As a result, in the channel unit 15, there are formed a multiplicity of individual ink channels 132 extending from the four manifold channels 105 to the ink-ejection openings 108*a* of the nozzle holes 108 via the sub-manifold channels 105*a*, outlets of the respective sub-manifold channels 105*a*, and the pressure chambers 110.

The ink supplied from the ink reservoir into the channel unit 15 via ink-supply openings 105*b* is diverted from the manifold channels 105 into the sub-manifold channels 105*a*. The ink in the sub-manifold channels 105*a* flows into each of the individual ink channels 132 and reaches a corresponding one of the nozzle holes 108 via a corresponding one of the apertures 112 each functioning as a restrictor and via a corresponding one of the pressure chambers 110.

Figure 5:
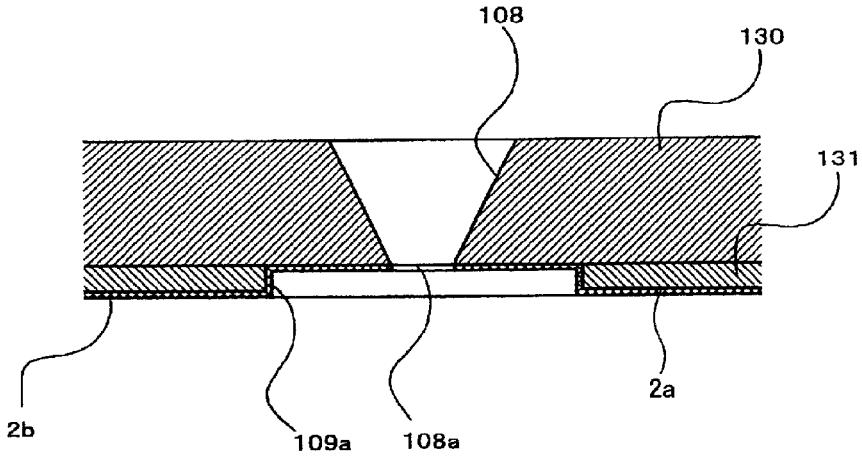
FIG. 5 is an enlarged cross-sectional view of a nozzle hole shown in FIG. 4.

A lower face of the nozzle plate 130 is the ink-ejection face 2*a*. As shown in FIGS. 5 and 6, ten grooves 109*a* and six grooves 109*b* each having a smaller constant width than each groove 109*a* and extending in the main scanning direction are formed in the ink-ejection face 2*a* so as to extend in the main scanning direction. Each of the grooves 109*a*, 109*b* has a specific width in the sub-scanning direction. The grooves 109*a*, 109*b* are arranged in parallel in the sub-scanning direction. In a bottom portion of each of the grooves 109*a*, 109*b* (i.e., on a portion defining a bottom of each groove 109*a*, 109*b*), the ink-ejection openings 108*a* are arranged in the main scanning direction so as to provide a single ink-ejection-opening row. From another point of view, each of the grooves 109*a*, 109*b* is formed by connecting a plurality of recessed portions to one another in the main scanning direction by connecting grooves (connecting portions). In each of the recessed portions, one or more of the ink-ejection openings 108*a* constituting the same ink-ejection-opening row are arranged. Each groove 109*a*, 109*b* is defined by the lower face of the nozzle plate 130 and an inner wall face of an elongated hole of the plated layer 131, the elongated hole exposing the ink-ejection-opening row. Further, a water (liquid) repellent layer 2*b* is formed on an entirety of the ink-ejection face 2*a* including the respective bottom portions of the grooves 109*a*, 109*b* (except the ink-ejection openings 108*a*). It is noted that a thickness of the plated layer 131 (i.e., a depth of the grooves 109*a*, 109*b*) is 2 μm.

In an area of the ink-ejection face 2*a* which faces the actuator unit 21, there are arranged in order from one side (an upper side in FIG. 6) in the sub-scanning direction (a) a groove group X1 constituted by two grooves 109*a*, (b) groove groups X2-X4 each constituted by two grooves 109*a* and two grooves 109*b* interposed between the two grooves 109*a*, and (c) a groove group X5 constituted by two grooves 109*a*. Each of the grooves 109*a* has a width (a length in the sub-scanning direction) of 0.2 mm, and each of the grooves 109*b* has a width of 0.1 mm.

A center-to-center distance in the sub-scanning direction between each two grooves 109*a* adjacent to each other and belonging to different groove groups among the groove groups X1-X5 is 1.78 mm ($l_1$=1.78 mm). In other words, the distance in the sub-scanning direction between a center of one groove 109*a* in the sub-scanning direction and a center of another groove 109*a* in the sub-scanning direction is 1.78 mm, wherein these two grooves 109*a* are adjacent to each other in the sub-scanning direction and partly constitute different groove groups among the groove groups X1-X5. In each of the groove groups X1, X5, a center-to-center distance between the grooves 109*a* in the sub-scanning direction is 0.75 mm ($l_4$=0.75 mm). In other words, in each of the groove groups X1, X5, the distance in the sub-scanning direction between a center of one of the grooves 109*a* in the sub-scanning direction and a center of the other of the grooves 109*a* in the sub-scanning direction is 0.75 mm, wherein these two grooves 109*a* are adjacent to each other in the sub-scanning direction. In each of the groove groups X2-X4, a center-to-center distance in the sub-scanning direction between the groove 109*a* and the groove 109*b* adjacent to each other is 0.5 mm ($l_2$=0.5 mm). In other words, in each of the groove groups X2-X4, the distance in the sub-scanning direction between a center of one of the grooves 109*a* in the sub-scanning direction and a center of one of the grooves 109*b* in the sub-scanning direction is 0.5 mm, wherein these two grooves 109*a*, 109*b* are adjacent to each other in the sub-scanning direction. Further, in each of the groove groups X2-X4, a center-to-center distance in the sub-scanning direction between the grooves 109*b* adjacent to each other is 0.24 mm ($l_3$=0.24 mm). In other words, in each of the groove groups X2-X4, the distance in the sub-scanning direction between a center of one of the grooves 109*b* in the sub-scanning direction and a center of the other of the grooves

109*b* in the sub-scanning direction is 0.24 mm, wherein these two grooves 109*b* are adjacent to each other in the sub-scanning direction.

As thus described, two grooves adjacent to each other among the grooves 109*a*, 109*b* and having respective outlines connected by the shortest line segment among the grooves have respective widths equal to each other and each shorter than the width of each groove other than the grooves. In the present embodiment, two grooves 109*b* whose separation distance is the shortest in the sub-scanning direction among the grooves 109*a*, 109*b* have respective widths equal to each other and each shorter than the width of each groove 109*a*. The shortest separation distance is 0.14 (0.24-0.1) mm in the present embodiment. It is noted that the separation distance is a distance between two of the grooves 109*a*, 109*b* in the sub-scanning direction.

Further, where a separation distance between two grooves adjacent to each other among the grooves 109*a*, 109*b* is equal to or shorter than five times an average value of widths of the respective two grooves, the shorter the separation distances each between the two grooves, the smaller the average values each corresponding to the widths of the respective two grooves are. In other words, in the case where a separation distance between each two grooves of the grooves 109*a*, 109*b* is equal to or shorter than five times an average value of widths of the respective two grooves, where a separation distance between a certain pair of the grooves is shorter that that between another pair of the grooves, the average value of respective widths of the certain pair of the grooves is smaller than that of respective widths of the another pair of the grooves. Specifically, an average value of the respective widths of the two grooves 109*a* adjacent to each other at a separation distance of 0.55 (0.75-0.2) mm is 0.2 mm. An average value of the respective widths of the groove 109*a* and the groove 109*b* adjacent to each other at a separation distance of 0.35 (0.50-0.15) mm is 0.15 mm. An average value of the respective widths of the two grooves 109*b* adjacent to each other at a separation distance of 0.14 mm is 0.1 mm.

On the other hand, where a separation distance between two grooves of the grooves 109*a*, 109*b* is longer than five times an average value of widths of the respective two grooves, the average value of the widths of the respective two grooves is equal to the largest (longest) value among average values of widths of respective pairs of grooves, wherein a separation distance of each of the pairs of grooves is equal to or shorter than five times the average value of the widths of the respective two grooves. Specifically, as described above, the largest (longest) value among average values of widths of respective pairs of grooves, each of whose separation distance is equal to or shorter than five times the average value of the widths of the respective two grooves, is 0.2 mm. Accordingly, an average value of the respective widths of the grooves 109*a* adjacent to each other at the separation distance of 1.58 (1.78-0.2) mm is 0.2 mm.

Further, in a case where there is a third groove 109*b* which is adjacent to one groove 109*b* of two grooves 109*a*, 109*b* adjacent to each other and having different widths, with the third groove 109*b* and the other groove 109*a* of the two grooves 109*a*, 109*b* being located respectively on opposite sides of the one groove 109*b* (that is, the third groove 109*b* is located on the other side of the one groove 109*b* from the other groove 109*a*), and where a separation distance between the one groove 109*b* and the third groove 109*b* is shorter than a separation distance between the two grooves 109*a*, 109*b*, a width of the one groove 109*b* is smaller than that of the other groove 109*a*. On the other hand, where the separation distance between one groove 109*a* of the two grooves 109*a*, 109*b* and a third groove 109*a* is longer than the separation distance between the two grooves 109*a*, 109*b*, the width of the one groove 109*a* is larger than that of the other groove 109*b*.

For example, in a case of the groove 109*a* and the groove 109*b* of the groove group X2 that are adjacent to each other at the separation distance of 0.35 mm in the present embodiment, a separation distance between the groove 109*a* as one of the two grooves 109*a*, 109*b* and a groove 109*a* as a third groove is 1.58 mm, wherein the third groove 109*a* is adjacent to the one groove 109*a*, with the third groove 109*a* and the other groove 109*b* being located respectively on opposite sides of the one groove 109*a* (that is, the third groove 109*a* is located on the other side of the one groove 109*a* from the other groove 109*b*). Accordingly, a width of the one groove 109*a* (0.2 mm) is larger than that of the other groove 109*b* (0.1 mm). In contrast, in the case of the groove 109*a* and the groove 109*b* of the groove group X2 that are adjacent to each other at the separation distance of 0.35 mm, a separation distance between the groove 109*b* as one of the two grooves 109*a*, 109*b* and a groove 109*b* as a third groove is 0.14 mm, wherein the third groove 109*b* is adjacent to the one groove 109*b*, with the third groove 109*b* and the other groove 109*a* being located respectively on opposite sides of the one groove 109*b* (that is, the third groove 109*b* is located on the other side of the one groove 109*b* from the other groove 109*a*). Accordingly, a width of the one groove 109*b* (0.1 mm) is smaller than that of the other groove 109*a* (0.2 mm).

Figure 7:
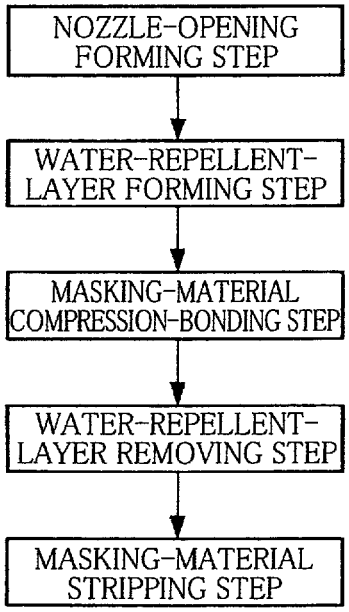
FIG. 7 is a block diagram showing a process of manufacturing the ink-jet head shown in FIG. 1.
Figure 8A:
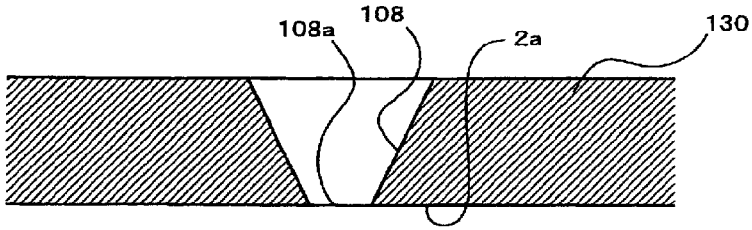
FIGS. 8A-8E are views for explaining the process of manufacturing the ink-jet head shown in FIG. 4.

There will be next explained a method of manufacturing the head 2, concentrating on a step for forming the nozzle plate 130. As shown in FIG. 7, the method of manufacturing the head 2 includes a nozzle-opening forming step (a base-material forming step (process)), a water-repellent-layer forming step (process), a masking-material compression-bonding step (process), a water-repellent-layer removing step (process), and a masking-material stripping (removing) step (process). As shown in FIG. 8A, in the nozzle-opening forming step, each nozzle hole 108 is formed through a metal plate-like base material for forming the nozzle plate 130, so as to be tapered toward the ink-ejection face 2*a*. Specifically, the plate-like base material is pressed by a tapered punch from a face of the plate-like base material which is opposite to a face to be the ink-ejection face 2*a*, whereby a distal end of the punch penetrates the plate-like base material. The ink-ejection face 2*a* is then polished to remove burrs formed on a periphery of an end portion of each nozzle hole 108. As a result, the ink-ejection openings 108*a* each having a predetermined opening diameter are formed in end portions of the respective nozzle holes 108.

Figure 8B:
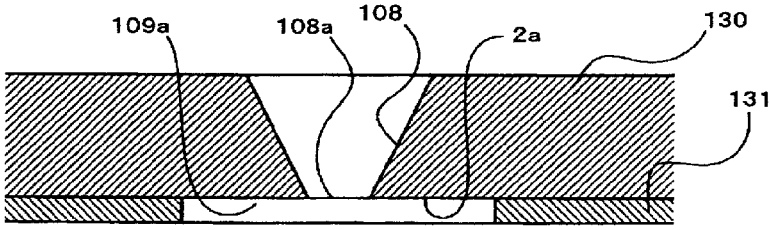

Further, as shown in FIG. 8B, the nickel plated layer 131 is formed on the ink-ejection face 2*a* (having the ink-ejection opening 108*a* opened therein) of the plate-like base material in which the nozzle hole 108 is formed. After masking of areas of the ink-ejection face 2*a* in which the grooves 109*a*, 109*b* are to be formed, electrolytic nickel plating is performed on the ink-ejection face 2*a* by soaking the ink-ejection face 2*a* in an electrolytic solution, whereby the plated layer 131 is formed on the ink-ejection face 2*a*.

Specifically, a photosensitive resist sheet is pasted on an entirety of the ink-ejection face 2*a* and then exposed to light via a mask. The mask has openings opened therein which respectively correspond to the ink-ejection openings 108*a*. Each opening has a widthwise center line passing through a center of the corresponding ink-ejection opening 108*a* and has a width about five times as large as that of the corresponding ink-ejection opening 108*a* having an opening diameter of about 20 μm, for example. A length of the opening in a longitudinal direction thereof is generally equal to a distance between two oblique lines of the respective two actuator units 21, which oblique lines are opposed to each other in an opposed area of the actuator units 21. In plan view, each of the ink-ejection-opening rows is included in a corresponding one of the openings. After the light exposure, portions of the resist sheet which have not been exposed to the light are removed by a developer, whereby portions of the resist sheet which have been exposed to the light remain on the ink-ejection face 2*a*. The exposed portions of the resist sheet seal all the ink-ejection openings 108*a* of the ink-ejection-opening rows. In this state, the electrolytic plating is performed, whereby the plated layer 131 having a thickness of 2 μm is formed, for example. The nozzle plate 130 is then cleaned to remove the masking material, resulting that the grooves 109*a*, 109*b* are formed in the ink-ejection face 2*a*.

Figure 8C:
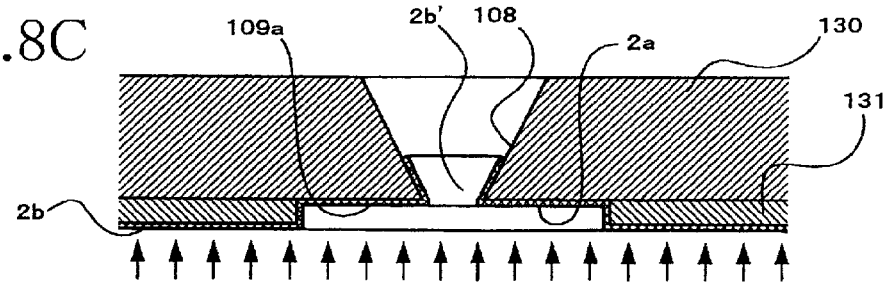

As shown in FIG. 8C, in the water-repellent-layer forming step, the water repellent layer 2*b* is formed on the ink-ejection face 2*a* in which the grooves 109*a*, 109*b* are formed in the nozzle-opening forming step. Specifically, a water repellent agent is applied, by spraying, to the ink-ejection face 2*a*, and a heat treatment is then applied to the nozzle plate 130 to form the water repellent layer 2*b*. In applying the water repellent agent, part of the water repellent agent enters into the nozzle holes 108 through the respective ink-ejection openings 108*a*, whereby an unnecessary water repellent layer 2*b*' is formed partly on inner wall face of each nozzle hole 108. It is noted that the water repellent layer 2*b* may be formed by a physical vapor deposition (evaporating) or a chemical vapor deposition (evaporating).

Figure 8D:
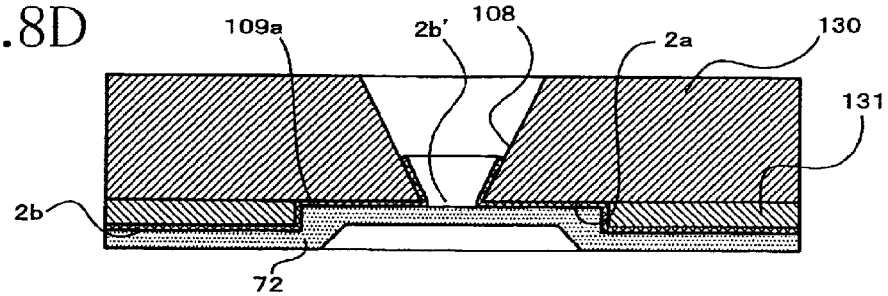
Figure 9:
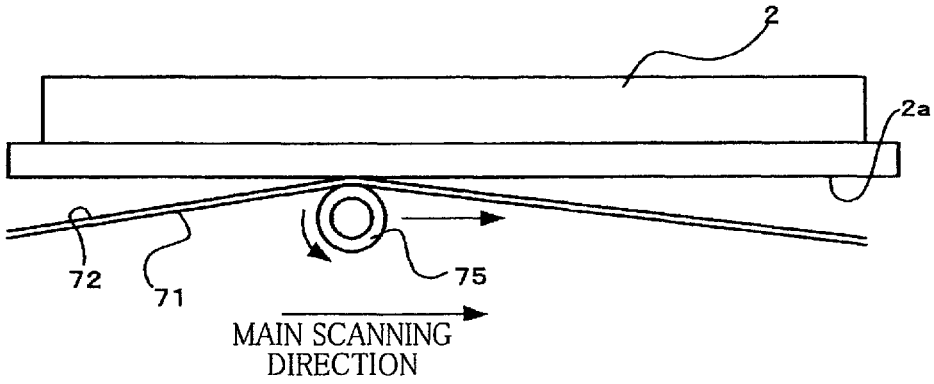
FIG. 9 is a view for explaining a masking-material compression-bonding step shown in FIG. 7.

As shown in FIG. 8D, in the masking-material compression-bonding step, a masking material 72 and the ink-ejection face 2*a* on which the water repellent layer 2*b* is formed are compressed and bonded together by a roller transferring method. Specifically, as shown in FIG. 9, a roller 75, while contacting a tape material 71, is rotated and moved from one to the other of opposite end portions of the ink-ejection face 2*a* in the main scanning direction such that the masking material 72 is pressed onto the ink-ejection face 2*a* at a specific pressure in a state in which the masking material 72 held on a surface of the tape material 71 faces the ink-ejection face 2*a*. A pressing force of the roller 75 is exerted in a direction perpendicular to the direction in which the grooves 109*a*, 109*b* extend. As described above, where the separate distance between two grooves of the grooves 109*a*, 109*b* is equal to or shorter than five times the average value of the widths of the respective two grooves, the shorter the separation distances each between the two grooves, the smaller the average values each corresponding to the widths of the respective two grooves are. Thus, when the masking material 72 is compressed and bonded to the ink-ejection face 2*a*, amounts of the masking material 72 entering into the respective grooves 109*a*, 109*b* are made uniform or equal. Consequently, it is possible to prevent the masking material 72 from entering the nozzle holes 108 by adjusting a pressure at which the roller 75 presses the masking material 72 via the tape material 71. Even if the masking material 72 has entered into the nozzle holes 108, amounts of the masking material 72 having entered into the respective nozzle holes 108 are uniform.

Figure 8E:
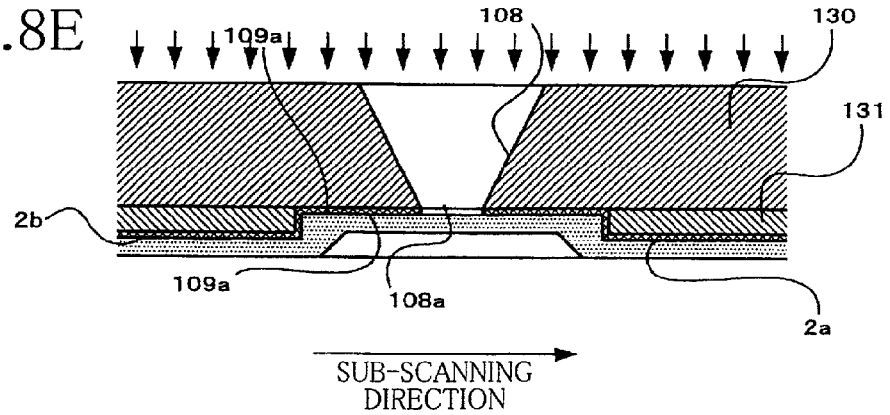

As shown in FIG. 8E, in the water-repellent-layer removing step, a plasma etching treatment is applied to the nozzle plate 130 from the face of the nozzle plate 130 which is opposite to the ink-ejection face 2*a* having been masked in the masking-material compression-bonding step. As a result, the unnecessary water repellent layer 2*b*' formed on the inner wall face of each nozzle hole 108 which is not masked by the masking material 72 is removed.

In the masking-material stripping step, the masking material 72 is stripped or removed from the ink-ejection face 2*a* of the nozzle plate 130 from which the unnecessary water repellent layer 2*b*' has been removed in the water-repellent-layer removing step. The nozzle plate 130 is then cleaned and dried. As a result, forming the nozzle plate 130 is completed.

As described above, in the ink-ejection face 2*a* of the head 2 of the present embodiment, where the separate distance between two grooves of the grooves 109*a*, 109*b* is equal to or shorter than five times the average value of the widths of the respective two grooves, the shorter the separation distances each between the two grooves, the smaller the average values each corresponding to the widths of the respective two grooves are. Accordingly, when the masking material 72 is compressed and bonded to the ink-ejection face 2*a* in the masking-material compression-bonding step, pressures at which the masking material 72 enters into the respective grooves 109*a*, 109*b* are made uniform. That is, the amounts of the masking material 72 entering into the respective grooves 109*a*, 109*b* are made uniform. Consequently, it is possible to prevent the masking material 72 from entering into the nozzle holes 108 by adjusting the pressure at which the roller 75 presses the masking material 72 via the tape material 71. As a result, it is possible to accurately remove only the water repellent layer 2*b*' formed in each nozzle hole 108, thereby suppressing variations in ink ejection properties among the ink-ejection openings 108*a*. Likewise, when a wiper for cleaning the ink-ejection face 2*a* is brought into contact with the ink-ejection face 2*a*, depths or distances in which the wiper enters into the respective grooves 109*a*, 109*b* can be made uniform. As a result, it is possible to uniformly clean the ink-ejection face 2*a* and to prevent partial deterioration of the wiper and the ink-ejection face 2*a* and partial shortage of the contact pressure of the wiper.

In addition, where a separation distance between two grooves of the grooves 109*a*, 109*b* is longer than five times an average value of widths of the respective two grooves, the pressures at which the masking material 72 enters into the respective grooves 109*a*, 109*b* (i.e., the amounts of the masking material 72 entering into the respective grooves 109*a*, 109*b*) are less likely to be changed by the separation distance. Thus, it is possible to efficiently make the pressures uniform at which the masking material 72 enters into the respective grooves 109*a*, 109*b*, by changing the average value of respective widths of each pair of the grooves 109*a*, 109*b* only in the case where a separation distance between two grooves of the grooves 109*a*, 109*b* is equal to or shorter than five times an average value of widths of the respective two grooves. Further, it is possible to prevent the separation distance from becoming relatively long, thereby preventing an upsizing of the head 2.

Where a separation distance between two grooves of the grooves 109*a*, 109*b* is longer than five times an average value of widths of the respective two grooves, the average value of the widths of the respective two grooves is equal to the largest (longest) value among average values of widths of respective pairs of grooves 109*a*, 109*b*, wherein a separation distance of each of the pairs of grooves is equal to or shorter than five times the average value of the widths of the respective two grooves. This facilitates designing the grooves 109*a*, 109*b*. In addition, it is possible to prevent a rigidity or a stiffness of the nozzle plate 130 from lowering. The lowering of the rigidity of the nozzle plate 130 leads to a lowering of a rigidity of the head 2, which may cause a deformation of the head 2 when the head 2 is mounted on the printer 1 (especially in the case of the elongated head 2). Since the deformation of the head 2 lowers a recording quality, maintaining the width at a value equal to or smaller than the predetermined value leads to maintaining the recording quality.

Further, two grooves 109*b* whose separation distance is the shortest in the sub-scanning direction among the grooves 109*a*, 109*b* have respective widths equal to each other and each equal to or shorter than the width of each groove 109*a*. Accordingly, it is possible to reliably prevent the masking material 72 from entering too much into the two grooves 109*b* closest to each other and to make uniform the pressures at which the masking material 72 enters into the two grooves 109*b*, thereby making the entering amount of the masking material 72 uniform.

Further, where there is a third groove 109*a* or 109*b* which is adjacent to one of two grooves 109*a*, 109*b* adjacent to each other and having different widths and which is located on the other side of the one of the two grooves 109*a*, 109*b* from the other of the two grooves 109*a*, 109*b*, a size relationship among the widths of the respective pairs of the grooves 109*a*, 109*b* is determined by a size relationship among the separation distances of the respective pairs of the grooves 109*a*, 109*b*. Thus, it is possible to make uniform the pressures at which the masking material 72 enters into the two grooves 109*a*, 109*b*, thereby making the entering amount of the masking material 72 uniform.

In addition, the width of each of the grooves 109*a*, 109*b* is constant over its entire length (except opposite end portions thereof), which facilitates forming the grooves 109*a*, 109*b*. In addition, it is possible to efficiently make the pressures uniform at which the masking material 72 enters into the respective grooves 109*a*, 109*b*, thereby making the entering amount of the masking material 72 uniform.

Further, each of the grooves 109*a*, 109*b* is defined by the lower face of the nozzle plate 130 and the inner wall face of the corresponding elongated hole of the plated layer 131, which elongated hole exposes the ink-ejection-opening row. This further facilitates forming the grooves 109*a*, 109*b*.

In addition, in the masking-material compression-bonding step, the roller 75, while contacting the tape material 71, is rotated and moved from one to the other of opposite end portions of the ink-ejection face 2*a* in the main scanning direction such that the masking material 72 is pressed onto the ink-ejection face 2*a* in the state in which the masking material 72 held on the surface of the tape material 71 faces the ink-ejection face 2*a*. Thus, it is possible to efficiently make the pressures uniform at which the masking material 72 enters into the respective grooves 109*a*, 109*b*, thereby making the entering amount of the masking material 72 uniform.

<First Modification>

Figure 10:
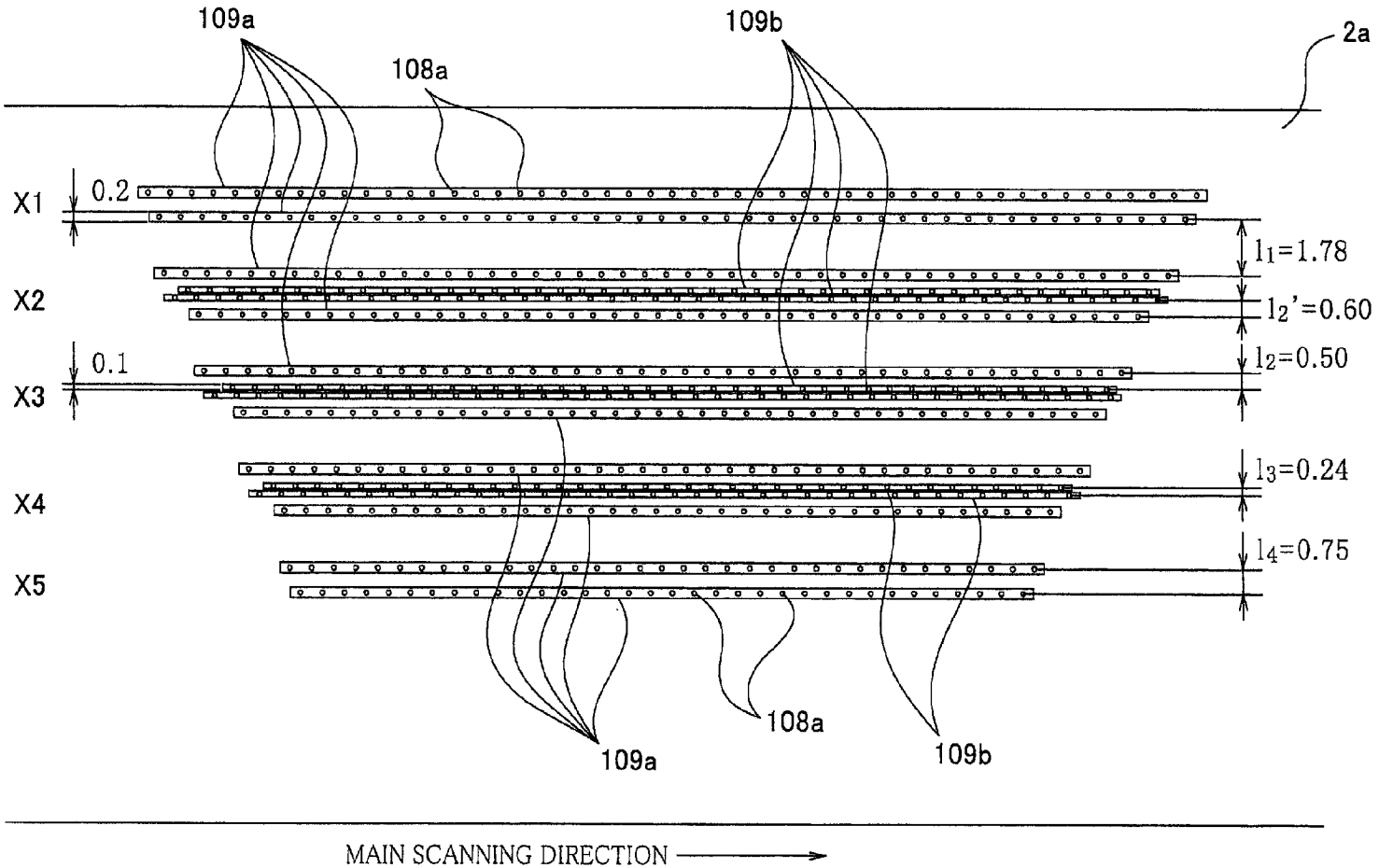
FIG. 10 is a partly enlarged view of an ink-ejection face of a first modification of the embodiment.

In the above-described embodiment, as the separation distance between the two grooves of the grooves 109*a*, 109*b* decreases, the average value of the widths of the respective two grooves decreases, but (a) an average value of lengths of respective two recessed portions, in a direction along the shortest line segment thereof, having a separation distance included in one of a plurality of ranges of lengths of the respective separation distances and (b) an average value of lengths of respective other two recessed portions, in a direction along the shortest line segment thereof, having a separation distance included in the one range may be the same as each other. This construction is applied to the case where the separation distance between the two grooves is equal to or shorter than five times the average value of the widths of the respective two grooves, for example. Specifically, as shown in FIG. 10, a range of the separation distances from the separation distance equal to five times the average value of the widths of the respective grooves to the smallest separation distance is divided into a plurality of ranges. For example, a range of one of the separation distances is set as a range of a separation distance equal to two to three times an average value of widths of respective two grooves. In this case, two grooves 109*a*, 109*b* (whose center-to-center distance $l_2$ is 0.50 mm and separation distance is 0.35 (0.50-0.15) mm) and other two grooves 109*a*, 109*b* (whose center-to-center distance $l_2'$ is 0.60 mm and separation distance is 0.45 (0.60-0.15) mm) each pair having the separation distance included in the same separation-distance range have the same average value (0.15 mm) of their widths. In this case, the width of the respective two grooves may be the same as each other and may be different from each other. This further facilitates the designing of the grooves.

Figure 11:
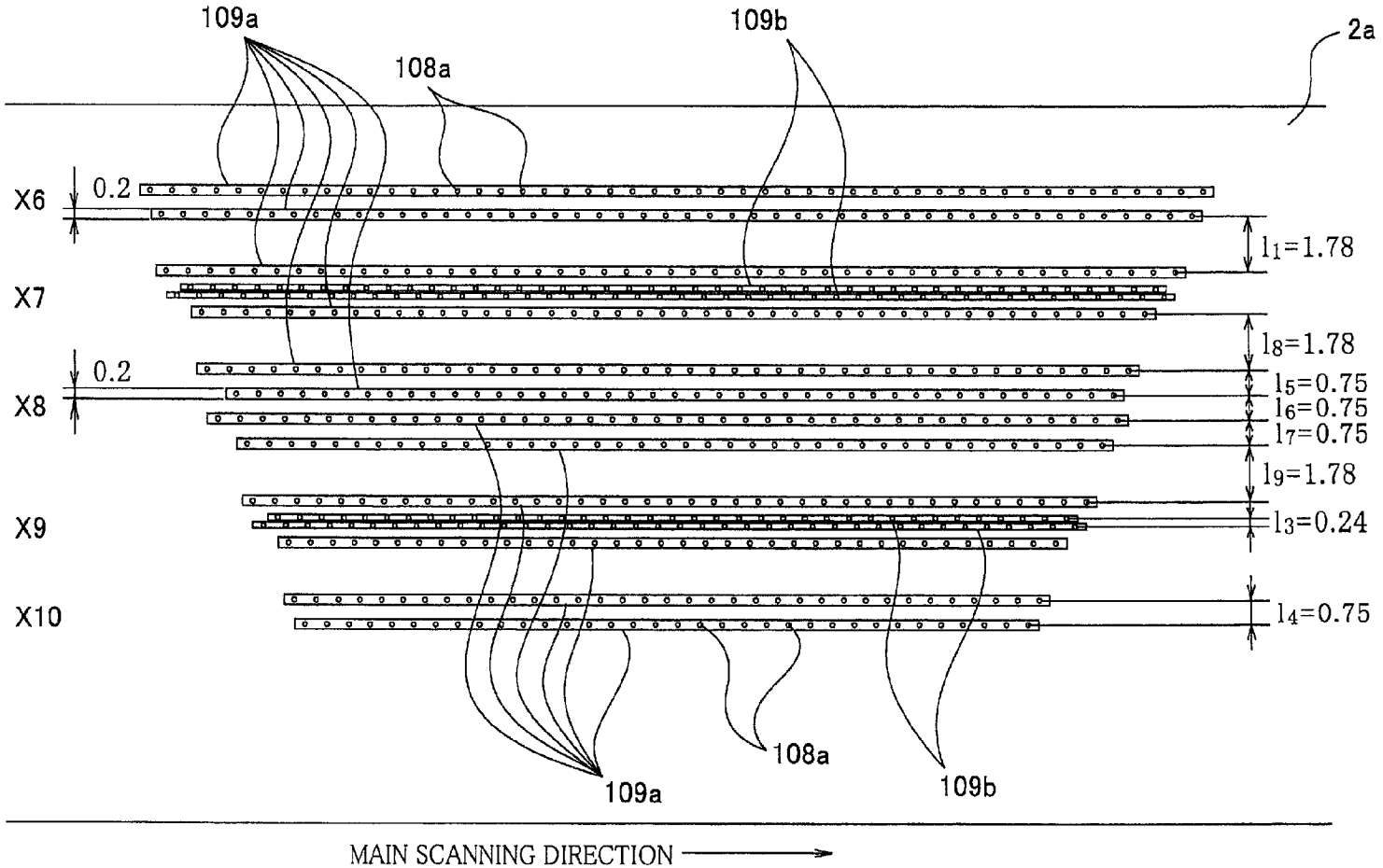
FIG. 11 is a partly enlarged view of an ink-ejection face of another modification of the embodiment.
Figure 12:
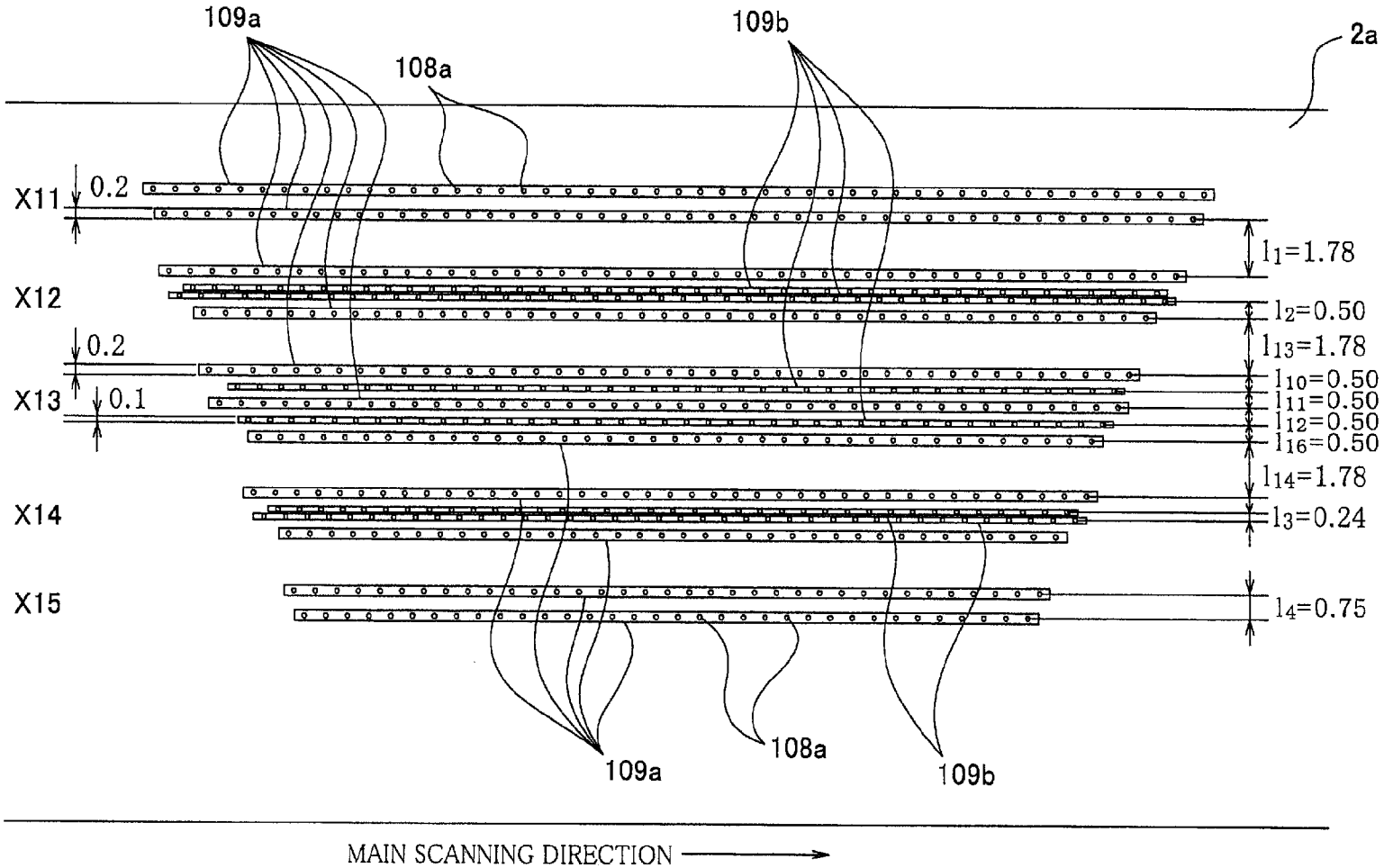
FIG. 12 is a partly enlarged view of an ink-ejection face of another modification of the embodiment.

Further, the present invention is applicable to the following construction. For example, as shown in FIGS. 11 and 12, where a separation distance between two grooves in the same area (that is an area in which is formed a groove group X8 in FIG. 11 and that is an area in which is formed a groove group X13 in FIG. 12) of a plurality of areas in each of which the two grooves are adjacent to each other in the sub-scanning direction (noted that the plurality of areas are areas in which are formed groove groups X6-X10 in FIG. 11, and are areas in which are formed groove groups X11-X15 in FIG. 12) is the same as a separation distance between other two grooves located in the same area (noted that the separation distance is 0.55 mm (0.75 mm ($=l_5=l_6=l_7$)−0.2 mm) in FIG. 11, and is 0.35 mm (0.50 mm ($=l_{10}=l_{11}=l_{12}=l_{16}$)−0.15 mm) in FIG. 12), an average value of widths of the respective two grooves in the same area may be the same as an average value of widths of the respective other two grooves in the same area (the average value is 0.2 mm in FIG. 11 and is 0.15 mm in FIG. 12). As shown in FIG. 11, width of the respective two grooves 109*a* in the same area may be the same width and, as shown in FIG. 12, may be different from each other. This further facilitates the designing of the grooves.

<Second Modification>

In the above-described embodiment, all the opening diameters of the ink-ejection openings 108*a* opened in the bottom portions of the grooves 109*a*, 109*b* are the same, but the opening diameters of the ink-ejection openings 108*a* may vary among the grooves. For example, the opening diameter of each of the ink-ejection openings 108*a* of one of the grooves adjacent to each other may be larger than the opening diameter of each of the ink-ejection openings 108*a* of the other of the grooves. Where this printer 1 is configured in this manner, a size relationship of the opening diameters of the ink-ejection openings which are different from each other is preferably the same as a size relationship of respective widths of two grooves in which the ink-ejection openings are respectively opened. This facilitates adjusting the pressure at which the masking material is pressed, such that the masking material does not enter into the ink-ejection openings in the masking-material compression-bonding step.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. In the above-described embodiment, the ink-ejection openings 108*a* are opened in the bottom portions of the respective grooves 109*a*, 109*b* extending in the main scanning direction, but the grooves may extend in a direction other than the main scanning direction and may extend in different directions. Further, instead of the grooves, the ink-ejection openings may be opened in bottom portions of recessed portions each having another shape such as a circular shape. For example, where the circular recessed portions are employed, a center of each ink-ejection opening and a center of a corresponding one of the recessed portions preferably coincide with each other.

Further, one or more of the ink-ejection openings may be opened in the bottom portion of each groove or recessed portion. Further, no ink-ejection openings may be opened in the bottom portion of one of two grooves adjacent to each other or one of two recessed portions adjacent to each other. It is noted that, in this case, the separation distance of the two grooves adjacent to each other or the two recessed portions adjacent to each other is determined by a length of the shortest line segment connecting respective outlines of the two grooves or the two recessed portions to each other. Further, a width of each groove or each recessed portion has the same length as the line segment.

Further, in the above-described embodiment, where the separate distance between two grooves of the grooves 109*a*, 109*b* is equal to or shorter than five times the average value of the widths of the respective two grooves, the shorter the separation distances each between the two grooves, the smaller the average values each corresponding to the widths of the respective two grooves are, but this printer 1 is not limited to this configuration. For example, this printer 1 may be configured such that, even where the separation distance is longer than five times the average value of the widths of the respective two grooves, the shorter the separation distances each between the two grooves, the smaller the average values each corresponding to the widths of the respective two grooves are.

Further, in the above-described embodiment, where a separation distance between two grooves of the grooves 109*a*, 109*b* is longer than five times an average value of widths of the respective two grooves, the average value of the respective two grooves is equal to the largest (longest) value among the average values of the widths of the respective pairs of grooves, wherein the separation distance of each of the pairs of grooves is equal to or shorter than five times the average value of the widths of the respective two grooves, but the average value of the respective two grooves may be a value larger than the largest (longest) value.

In addition, in the above-described embodiment, the two grooves 109*b* whose separation distance is the shortest in the sub-scanning direction among the grooves 109*a*, 109*b* have respective widths equal to each other and each equal to or shorter than the width of each groove 109*a*, but this printer 1 is not limited to this configuration. For example, the two grooves 109*b* may have different widths. In this case, one of the widths may be greater than the width of the groove 109*b*.

Further, in the above-described embodiment, where there is a third groove 109*a* or 109*b* which is adjacent to one of two grooves 109*a*, 109*b* adjacent to each other and having different widths and which is located on the other side of the one of the two grooves 109*a*, 109*b* from the other of the two grooves 109*a*, 109*b*, a size relationship among the widths of the respective pairs of the grooves 109*a*, 109*b* is determined by a size relationship among the separation distances of the respective pairs of the grooves 109*a*, 109*b*, but this printer 1 is not limited to this configuration. That is, the widths of the respective pairs of the grooves 109*a*, 109*b* may be determined independently of the size relationship among the separation distances of the respective pairs of the grooves 109*a*, 109*b*. For example, where the separation distance between the one of the two grooves 109*a*, 109*b* and the third groove 109*a* or 109*b* is shorter than the separation distance between the two grooves 109*a*, 109*b*, the width of the one of the two grooves 109*a*, 109*b* may be larger than that of the other of the two grooves 109*a*, 109*b*. Further, where the separation distance between the one of the two grooves 109*a*, 109*b* and the third groove 109*a* or 109*b* is longer than the separation distance between the two grooves 109*a*, 109*b*, the width of the one of the two grooves 109*a*, 109*b* may be smaller than that of the other of the two grooves 109*a*, 109*b*.

In addition, in the above-described embodiment, the width of each of the grooves 109*a*, 109*b* is constant but may be changed at a part of the groove. For example, each connecting groove may have a width smaller than the other part.

Further, in the above-described embodiment, each of the grooves 109*a*, 109*b* is defined by the lower face of the nozzle plate 130 and the inner wall face of the corresponding elongated hole of the plated layer 131, which elongated hole exposes the ink-ejection-opening row, but this printer 1 is not limited to this configuration. For example, each of the grooves 109*a*, 109*b* may be formed by performing an etching work, a punching work, or a cutting work for the nozzle plate 130.

In addition, in the above-described embodiment, in the masking-material compression-bonding step, the roller 75, while contacting the tape material 71, is rotated and moved from one to the other of the opposite end portions of the ink-ejection face 2*a* in the main scanning direction such that the masking material 72 is pressed onto the ink-ejection face 2*a* in the state in which the masking material 72 held on the surface of the tape material 71 faces the ink-ejection face 2*a*, but this printer 1 is not limited to this configuration. For example, the head 2 may be moved in a state in which the roller 75 is fixed. Further, any mechanism may be used as a mechanism for pressing the masking material 72 onto the ink-ejection face 2*a*. For example, a pressing member having a pressing face may be used to press the masking material 72 onto an entire area of the ink-ejection face 2*a*.

In the above-described embodiment, the present invention is applied to the head 2 configured to eject the ink droplets, but the present invention is also applicable to any liquid ejection head configured to eject liquid other than the ink.

What is claimed is:

1. A liquid ejection head comprising:

a plate base material; and an actuator configured to apply a liquid-droplet ejection energy to liquid in the plate base material;

wherein the plate base material has: a plurality of ejection holes formed therein in a thickness direction thereof for ejecting liquid droplets; and an ejection face having a plurality of ejection openings opened therein, wherein the liquid droplets are ejected through the plurality of ejection holes and the plurality of ejection openings;

wherein the ejection face has a plurality of recessed portions arranged in a first direction formed therein, and at least one of the plurality of recessed portions has a bottom portion in which the plurality of ejection openings are opened;

wherein the plurality of recessed portions include a plurality of pairs thereof, each pair being constituted by two recessed portions located side by side in the first direction and respectively having bottom portions in at least one of which the plurality of ejection openings are formed;

wherein, the shorter that line segments are along the first direction, each connecting between outlines of respective two recessed portions of a corresponding one of the plurality of pairs of the recessed portions, the less that average values of lengths are in the first direction, each corresponding to an average value of lengths in the first direction of the respective two recessed portions of the corresponding one of the plurality of pairs of the recessed portions, each of the plurality of ejection openings of the corresponding one of the plurality of pairs having the same diameter.

2. The liquid ejection head according to claim 1, wherein the plurality of recessed portions include two recessed portions which are located side by side and whose shortest line segment is the shortest among all pairs of the plurality of recessed portions, and wherein a length of each of the two recessed portions in the direction along the shortest line segment thereof is equal to or shorter than a length of each of recessed portions other than the two recessed portions in the direction along the shortest line segment thereof.

3. The liquid ejection head according to claim 1, wherein the two recessed portions are located side by side and respectively have different lengths from each other in the direction along the shortest line segment thereof, wherein the plurality of recessed portions comprise a third recessed portion adjacent to one recessed portion of the two recessed portions, with the one recessed portion being interposed between the third recessed portion and the other recessed portion of the two recessed portions, wherein, where a shortest line segment of the one recessed portion and the third recessed portion is shorter than the shortest line segment of the two recessed portions, a length of the one recessed portion along the shortest line segment of the two recessed portions is shorter than a length of the other recessed portion along the shortest line segment of the two recessed portions, and wherein, where the shortest line segment of the other recessed portion and the third recessed portion is longer than the shortest line segment of the two recessed portions, the length of the other recessed portion along the shortest line segment of the two recessed portions is longer than the length of the one recessed portion along the shortest line segment of the two recessed portions.

4. The liquid ejection head according to claim 1, wherein the plurality of pairs of the recessed portions include a first pair and a second pair of the recessed portions, wherein, in each of the first and second pairs, a center-to-center distance between centers of respective two recessed portions in the direction along the shortest line segment thereof is equal to or shorter than five times an average value of lengths of the respective two recessed portions in the direction along the shortest line segment thereof, wherein each of the first and second pairs has a shortest line segment included in one range of a plurality of ranges of a length of a shortest line segment, and wherein the average value of the lengths of the respective two recessed portions of the first pair in the direction along the shortest line segment thereof and the average value of the lengths of the respective two recessed portions of the second pair in the direction along the shortest line segment thereof are the same as each other.

5. The liquid ejection head according to claim 1, wherein the plurality of pairs of the recessed portions include a first pair and a second pair of the recessed portions, wherein, in each of the first and second pairs, a center-to-center distance between centers of respective two recessed portions in the direction along the shortest line segment thereof is equal to or shorter than five times an average value of lengths of the respective two recessed portions in the direction along the shortest line segment thereof, wherein each of the first and second pairs is formed in one area of a plurality of areas arranged on the ejection face, and wherein, where a length of the shortest line segment of the two recessed portions of the first pair and a length of the shortest line segment of the two recessed portions of the second pair are the same as each other, an average value of the lengths of the respective two recessed portions of the first pair in the direction along the shortest line segment thereof is the same as an average value of the lengths of the respective two recessed portions of the second pair in the direction along the shortest line segment thereof.

6. The liquid ejection head according to claim 1, wherein, where a length of one recessed portion of the two recessed portions in the direction along the shortest line segment thereof is longer than a length of the other recessed portion of the two recessed portions in the direction along the shortest line segment thereof, each of opening diameters of the respective ejection openings formed in a bottom portion of the one recessed portion is larger than each of opening diameters of the respective ejection openings formed in a bottom portion of the other recessed portion.

7. The liquid ejection head according to claim 1, wherein a plurality of ejection-opening rows are formed in the ejection face, wherein the plurality of ejection openings are arranged in one direction in each of the plurality of ejection-opening rows, and wherein a groove as one recessed portion extending in the one direction is formed by connecting at least two of the recessed portions in the one direction, which at least two correspond to the plurality of ejection openings formed in the plurality of ejection-opening rows.

8. The liquid ejection head according to claim 1, wherein the recessed portion is defined by the ejection face and a plated layer formed so as to expose the plurality of ejection openings from the ejection face.

9. The liquid ejection head according to claim 1, wherein the on the bottom portions of the respective first recessed portions is covered by a liquid repellent layer which has not been removed due to a masking material having entered into the first recessed portions to cover the liquid repellent layer.

10. The liquid ejection head according to claim 2, wherein the two recessed portions which are located side by side and whose shortest line segment is the shortest have the same length in the direction along the shortest line segment thereof.

11. The liquid ejection head according to claim 7, wherein a length of the groove in the direction along the shortest line segment as a width of the groove is constant in the one direction.

12. The liquid ejection head according to claim 9, wherein the masking material covers the liquid repellent layer by being compressed and bonded to at least the ejection face, wherein the liquid repellent layer not covered by the masking material is removed, and wherein the masking material is removed after the liquid repellent layer has been removed.

13. The liquid ejection head according to claim 9, wherein the liquid repellent layer is formed by applying a water repellent agent by spraying.

14. The liquid ejection head according to claim 9, wherein the liquid repellent layer not covered by the masking material is removed by a plasma etching treatment applied from the other side of the base plate member from the ejection face.

15. The liquid ejection head according to claim 12, wherein the masking material is compressed and bonded to the ejection face by a pressing member moving relative to the base plate member in the one direction while pressing the masking material onto the ejection face.

16. The liquid ejection head according to claim 15, wherein the masking material is formed by a roller transferring method using a tape base material on which the masking material is stacked, wherein the tape base material has opposite faces, one of which contacts the masking material, and wherein the pressing member is configured to press the tape base material from the other of the opposite faces of the tape base material.

17. A liquid ejection head comprising:

a plate base material; and an actuator configured to apply a liquid-droplet ejection energy to liquid in the plate base material;

wherein the plate base material has: a plurality of ejection holes formed therein in a thickness direction thereof for ejecting liquid droplets; and an ejection face having a plurality of ejection openings opened therein, wherein the liquid droplets are ejected through the plurality of ejection holes and the plurality of ejection openings, wherein the ejection face has a plurality of recessed portions formed therein, and at least one of the plurality of recessed portions has a bottom portion in which the plurality of ejection openings are opened, wherein the plurality of recessed portions include a plurality of pairs thereof, each pair being constituted by two recessed portions located side by side and respectively having bottom portions in at least one of which the plurality of ejection openings are formed, wherein, where a shortest line segment of a certain pair of the recessed portions as a shortest one of line segments connecting outlines of the respective two recessed portions constituting the certain pair is equal to or shorter than that of another pair of the recessed portions, an average value of lengths of the respective two recessed portions constituting the certain pair is equal to or smaller than that of lengths of the respective two recessed portions constituting said another pair, wherein, in each of the certain pair and said another pair, a center-to-center distance between centers of the respective two recessed portions located side by side in the direction along the shortest line segment thereof is equal to or shorter than five times an average value of lengths of the respective two recessed portions in the direction along the shortest line segment thereof, and wherein, where the shortest line segment of the respective two recessed portions constituting the certain pair is equal to or shorter than that of another pair of the recessed portions, the average value of the lengths of the respective two recessed portions constituting the certain pair is equal to or smaller than that of lengths of the respective two recessed portions constituting said another pair.

18. The liquid ejection head according to claim 17, wherein, where the center-to-center distance between the centers of the respective two recessed portions located side by side in the direction along the shortest line segment thereof is larger than five times the average value of the lengths of the respective two recessed portions in the direction along the shortest line segment thereof, the average value of the lengths of the respective two recessed portions in the direction along the shortest line segment thereof is equal to a largest value among average values of lengths of other pairs of the recessed portions in the direction along the shortest line segment, the two recessed portions constituting each of said other pairs being located side by side in the direction along the shortest line segment, and wherein a center-to-center distance between centers of the two recessed portions constituting each of said other pairs in the direction along the shortest line segment thereof is equal to or shorter than five times the average value of the lengths of the respective two recessed portions in the direction along the shortest line segment thereof.

* * * * *